US008739996B2

(12) United States Patent
Looker

(10) Patent No.: US 8,739,996 B2
(45) Date of Patent: Jun. 3, 2014

(54) AIR CARGO CONTAINER WITH MOVEABLE STEP-UP PLATFORM

(71) Applicant: Satco, Inc., El Segundo, CA (US)

(72) Inventor: Peter Looker, El Segundo, CA (US)

(73) Assignee: Satco, Inc., El Segundo, CA (US)

( * ) Notice: Subject to any disclaimer, the term of this patent is extended or adjusted under 35 U.S.C. 154(b) by 0 days.

(21) Appl. No.: 13/652,679

(22) Filed: Oct. 16, 2012

(65) Prior Publication Data

US 2014/0103032 A1 Apr. 17, 2014

(51) Int. Cl.

| | |
|---|---|
| ***B65D 88/14*** | (2006.01) |
| ***B65D 88/12*** | (2006.01) |
| *B65D 88/10* | (2006.01) |

(52) U.S. Cl.

CPC ..... *B65D 88/14* (2013.01); *B65D 88/12* (2013.01); *B65D 88/10* (2013.01)

USPC ..... 220/1.5; 220/626; 105/436; 105/425

(58) Field of Classification Search

CPC .... B65D 88/14; B65D 88/129; B65D 88/127; B65D 88/121; B65D 88/12; B65D 88/10

USPC ..... 220/545, 548, 547, 544, 534, 529, 626, 220/625; 312/334.9, 334.8, 334.7, 334.1, 312/334.12, 334.18, 334.26, 334.33, 312/334.39, 334.43, 334.45; 217/7, 36, 5; 414/498; 105/436, 431, 430, 425

See application file for complete search history.

(56) References Cited

U.S. PATENT DOCUMENTS

| | | | | | |
|---|---|---|---|---|---|
| 305,199 | A | * | 9/1884 | Kiel | 414/537 |
| 369,292 | A | * | 8/1887 | Livingston et al. | 105/436 |
| 598,801 | A | * | 2/1898 | Minter | 220/529 |
| 884,526 | A | * | 4/1908 | Ripson et al. | 312/334.12 |
| 1,137,579 | A | * | 4/1915 | Cohn | 190/110 |
| 1,832,158 | A | * | 11/1931 | Vance | 220/548 |
| 2,261,839 | A | * | 11/1941 | Bergmann | 220/550 |
| 2,491,870 | A | * | 12/1949 | McLaughlin | 14/69.5 |
| 2,559,699 | A | * | 7/1951 | Bard et al. | 312/312 |
| 3,073,476 | A | * | 1/1963 | Heacock | 220/4.34 |
| 3,238,004 | A | * | 3/1966 | Goebel | 312/330.1 |
| 3,385,459 | A | * | 5/1968 | Wellman, Jr. | 414/498 |
| 3,456,826 | A | * | 7/1969 | Pavlik | 414/498 |
| 3,801,177 | A | * | 4/1974 | Fylling et al. | 312/351 |
| 4,538,663 | A | | 9/1985 | Looker | |
| 5,180,078 | A | | 1/1993 | Looker | |
| 5,217,132 | A | | 6/1993 | Looker | |

(Continued)

FOREIGN PATENT DOCUMENTS

EP 13591 A1 * 7/1980 ..... B65D 88/60

*Primary Examiner* — Robert J Hicks

(74) *Attorney, Agent, or Firm* — Kenneth H. Ohriner; Perkins Coie LLP

(57) ABSTRACT

An air cargo container has a rolling platform for cargo personnel to stand on. The platform may be moved horizontally as the container is loaded. A latch on the platform may be used to secure the platform into a desired position. The platform may be for example 8-20 inches higher than the floor of the container, to allow cargo personnel to conveniently step up onto to the platform, and reach the upper areas of the container. With the platform adjacent to the front or back of the container, the platform may optionally be rotated from horizontal into a vertical storage position, and then secured to a front or rear post of the container.

12 Claims, 3 Drawing Sheets

(56) References Cited

U.S. PATENT DOCUMENTS

| | | | | |
|---|---|---|---|---|
| 5,312,180 | A * | 5/1994 | Tieder et al. | 312/348.3 |
| 5,427,446 | A * | 6/1995 | Glomski | 312/242 |
| 5,601,201 | A | 2/1997 | Looker | |
| 5,630,537 | A * | 5/1997 | Sciacca | 224/629 |
| 6,530,475 | B1 * | 3/2003 | Penney | 206/320 |
| 6,824,338 | B2 | 11/2004 | Looker | |
| 7,063,227 | B2 | 6/2006 | Looker | |

* cited by examiner

AIR CARGO CONTAINER WITH MOVEABLE STEP-UP PLATFORM

BACKGROUND OF THE INVENTION

The field of the invention is air cargo containers.

Air cargo containers have been used for the transportation of cargo by aircraft for many years. Cargo such as cartons, smaller shipping containers, etc. are loaded into the containers. The containers are then loaded into an aircraft. Use of air cargo containers is much faster than loading cargo directly into the cargo space of the aircraft because the individual cartons need not be separately placed and secured within the aircraft. The air cargo containers can also be loaded at locations remote from the airport. Furthermore, because the cargo containers are typically designed and constructed to correspond to the interior dimensions of the aircraft cargo space, the containers fit more securely in the cargo space and do not shift during flight. These and other advantages of air cargo containers have made air cargo containers widely used in the air freight and airline industry.

New fuel efficient cargo aircraft are designed to carry so-called "high cube" cargo containers. These containers are containers are taller than standard cargo containers, with high cube containers typically 88, 96, 108, or 118 inches tall. Cargo personnel typically have difficulty loading and unloading packages into the top areas of high cube containers, especially at heights greater than about than 88 inches. On the other hand, if the cargo container can be filled with cargo up to its full height, the load density of the container is maximized. Since the load capacity of the aircraft is generally limited by cargo volume and not by weight, completely filling the air cargo containers allows the aircraft to carry more cargo, since empty space in the cargo containers is minimized.

While ladders or step stools allow cargo allow cargo personnel to reach the upper areas of the cargo containers, they have not been widely used. One disadvantage with use of a ladder is that the ladder may not be conveniently available, since it is removed from the air cargo container after each use. Another factor is that a ladder may not always be stable, especially when the floor of air cargo container is uneven, due to built in design elements, such as structural channel sections, fasteners and tie downs projecting up from the floor, or due to in-use wear, deformation, or damage to the floor.

Accordingly, engineering challenges remain in designing an air cargo container that allows cargo loading personnel to readily reach and place packages in upper areas of air containers.

SUMMARY OF THE INVENTION

In a new air cargo container, a light weight yet rigid platform structure may have rollers at each end rolling on a horizontal track on each side wall of the container. The platform may be incrementally moved horizontally from near the rear wall to near the front door opening of the container, as the container is loaded. A latch on the platform may be used to secure the platform into a desired position. The platform may be for example 8-20 inches higher than the floor of the container, to allow cargo personnel to conveniently step up onto to the platform, and reach the upper areas of the container while standing on the platform. If desired, after the back upper areas of the container are loaded, the loading platform can be sequentially moved towards the front of the container, to allow continued loading of remaining forward upper areas of the container. With the platform adjacent to the front of the container, the platform may optionally be rotated from horizontal into a vertical storage position, and then optionally secured to a front post of the container. In the storage position, the platform may act as a structural barrier between the cargo and the container door.

DETAILED DESCRIPTION OF THE DRAWINGS

Figure 1:
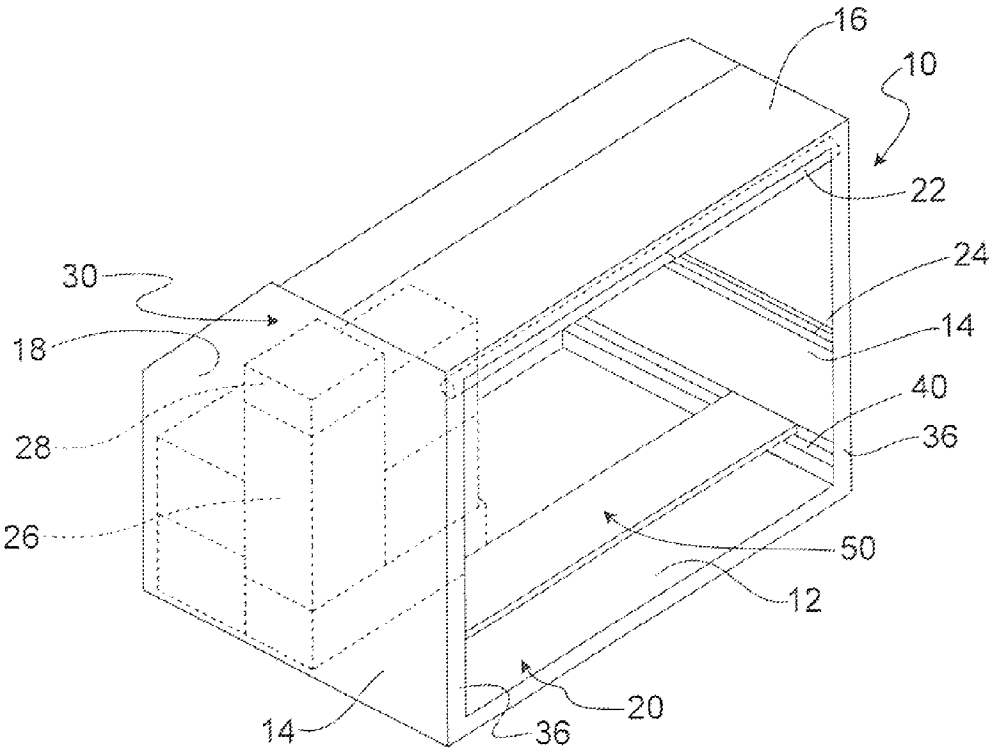
FIG. 1 is a perspective view of a new air cargo container having a loading platform.

As shown in FIG. 1, an air cargo container 10 has a floor 12, side walls 14, a roof or top 16, a back wall 18 and a front door opening 20. The container 10 may have various types of doors which close off the door opening 20 when the container is in transit. For example, the container 10 may have a fabric roll-up curtain door 22. The container may also have one or more mid-height hat or channel sections 24 to stiffen the side walls and provide structural strength.

FIG. 1 shows a container 10 partially loaded with packages such as packages 26 and 28. The package 28 is in an upper area 30 of the container 10, above the reach of cargo personnel. A rolling platform 50 is provided in the container 10 to provide a raised surface for the cargo personnel to stand on. The platform may be raised up above the floor 12 of the container 10 by up to 8, 10, 12, 14, 16, 18, 20, 22 or 24 inches. When standing on the platform 50, cargo personnel can readily reach the upper areas 30 of the container 10, so that they can more fully load the container. The platform may be 12 to 20 inches wide.

Figure 2:
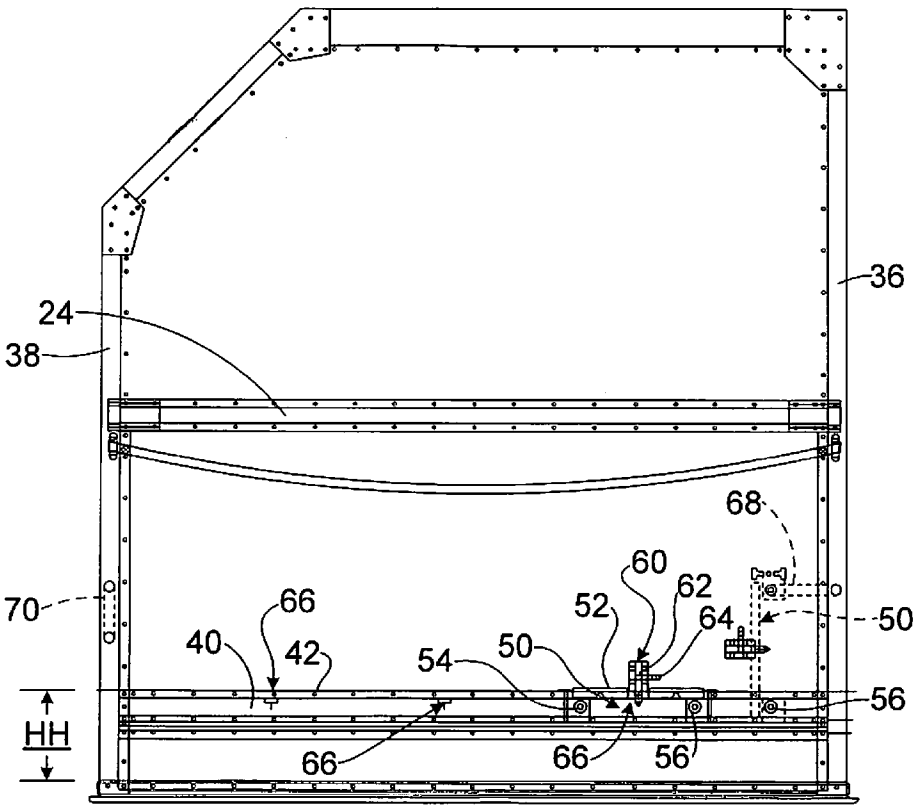
FIG. 2 is a section view of the container shown in FIG. 1.

As shown in FIG. 2, a platform rail or channel 40 may be attached to each of the side walls 14, for example via rivets 42 or other fasteners, or via welding or other techniques. The channels 40 may also be attached to the front post 36 and to the rear post 38 on both the first and second sides of the container 10.

Figure 3:
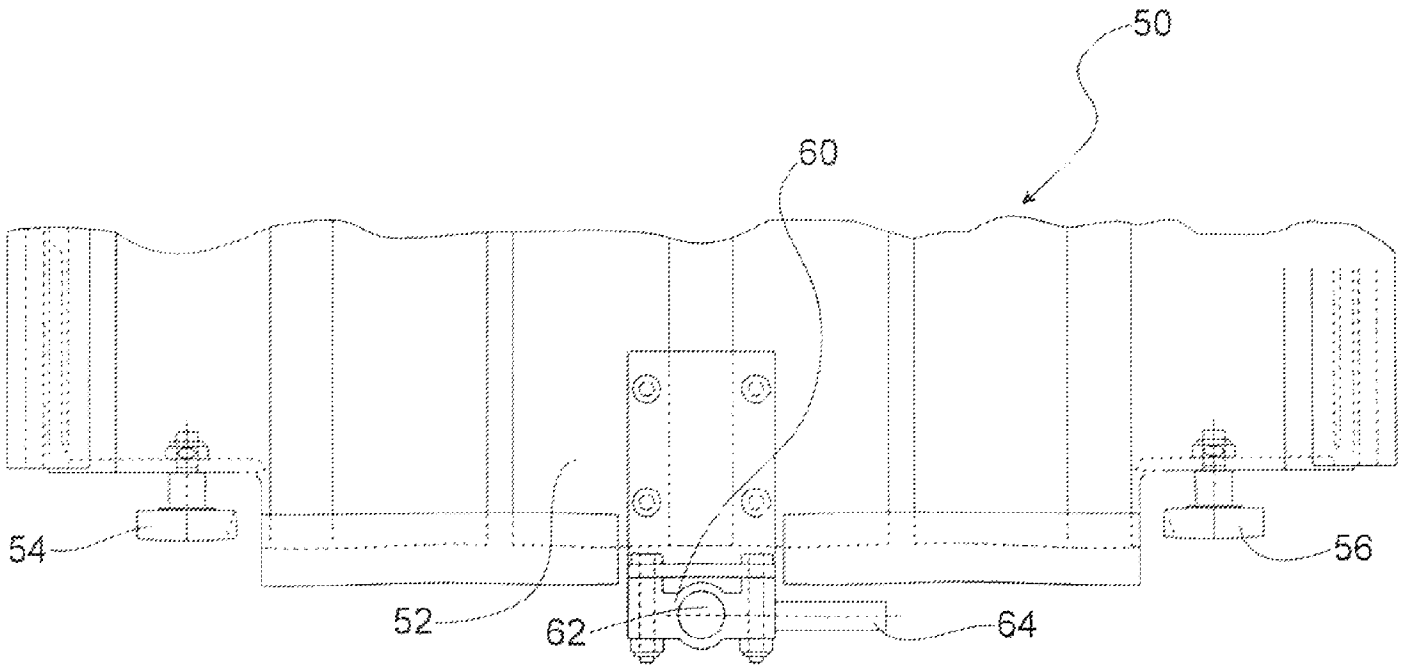
FIG. 3 is a partial top view of the loading platform shown in FIGS. 1 and 2.

Turning to FIGS. 2 and 3, the platform 50 has a standing surface 52, and may include a rear roller 54 and a front roller 56 on each side, with the rollers rolling on or in the channel 40. A latch 60 may be provided on one or both sides of the platform 50, with the latch 60 including a plunger 62 that may be moved down into a positioning hole 66 in the channel 40. A spring may urge the plunger 62 downwardly to hold the plunger 62 securely into the positioning hole 66. With the plunger 62 in the positioning hole 66, the platform is locked against movement. The plunger 62 may be withdrawn from the positioning hole 66 to move the platform 50 by pulling up on a plunger handle 64 attached to or linked to the plunger 62. Various other types of latches may be used, such as latches using cams, pins, clamps, brakes, toothed racks, or any other devices to hold the rolling platform in place. The latch may also operate automatically to lock the platform against movement when weight is on the platform 50.

In use, with the platform 50 initially closer to the front of the container, as shown in solid lines in FIG. 2, cargo personnel may load packages 26 starting at the back wall 18 and stacking the packages up from the floor 12. When the packages 26 reach a height that can no longer be easily reached by the cargo personnel, the cargo personnel may release the latch 60 and roll the platform 50 rearward to a position adjacent to the packages 26. The latch 60 is re-engaged to hold the platform at the new position. The cargo personnel can then stand on the platform 50 to load packages into the upper area 30 of the container 10, which area would not be reachable while standing on the floor 12 of the container 10. After packages are loaded in the upper area at the new position, the cargo personnel may move the platform further towards the front of the container 10, and then repeat the latching and loading steps.

Before the door 22 of the container is closed, the platform 50 may be pivoted into the vertical storage position shown in dotted lines in FIG. 2. In designs where the rear rollers 54 roll within the channels 40, a cutout may be provided in the top of the channel to allow the rear rollers 54 to be lifted out of the channel 40. A front link 68 on one or both sides may then be used to secure the platform 50 to the front post 36. When in the storage position, the platform 50 may act as a structural barrier between packages in the container and door. For containers having a curtain-type of door, the platform 50 in the vertical position may help to reduce strain on the door from shifted packages. The platform may of course also be used in the same way for un-loading the container.

The platform may also have an alternative vertical storage position adjacent to the back wall 18, with the rear vertical storage position design optionally being a mirror image of the front vertical storage design. A cutout in the channel 40 may be provided near the back end of the channels, to allow the front rollers 56 to lift up and out of the channel, as the platform is pivoted into the rear vertical storage position. A rear link 70 on one or both sides may optionally be used to secure the platform 50 to the rear post 38. With the platform 50 in the rear storage position, the interior of the cargo container is open and unobstructed, and is then virtually the same as a conventional cargo container. This allows the container 10 to be used without the platform 50, if desired. For example, the container 10 may be used to hold a pallet. With the platform 50 out of the way at the rear storage position, a pallet may be placed into the container 10 via a fork lift truck, in the same way as with a standard air cargo container.

Thus, a novel air cargo container has been shown and described. Various changes and substitutions may of course be made without departing from the spirit and scope of the invention. The invention, therefore, should not be limited except by the following claims and their equivalents.

The invention claimed is:

1. An air cargo container, comprising:
a floor;
first and second side walls attached to the floor;
first and second tracks attached to the first and second side walls, respectively; and
a platform above the floor;
first and second rear rollers and first and second front rollers on the platform, with the tracks comprising channels, and with the rollers in the channels;
with the platform moveable horizontally along the tracks, and with the platform having a standing surface for cargo personnel to stand on while loading air cargo into the container.

2. The air cargo container of claim 1 further comprising one or more latches on the platform for locking the platform in place on the tracks.

3. The air cargo container of claim 1 with the platform 8-16 inches above the floor.

4. The air cargo container of claim 1 further comprising first and second front posts, and first and second rear posts, attached to the first and second side walls, respectively, and with the first and second tracks attached to the first and second front posts, and to the first and second rear posts, respectively.

5. The air cargo container of claim 1 with the platform moveable from horizontal in-use position to a vertical storage position, adjacent to a door opening or to a rear wall of the container.

6. The air cargo container of claim 1 with the platform 12 to 20 inches wide.

7. The air cargo container of claim 1 with the front rollers captive in the channels.

8. The air cargo container of claim 2 with the latch comprising a plunger moveable into one of a plurality of positioning holes in the first track.

9. An air cargo container, comprising:
a floor;
first and second side walls attached to the floor;
first and second front posts attached to the floor and to the first and second side walls;
first and second rear posts attached to the floor and to the first and second side walls;
a rear wall attached to the first and second rear posts and to the floor;
a top attached to the first and second side walls;
first and second tracks attached to the first and second side walls;
a platform including first and second rear rollers and first and second front rollers supported on the first and second tracks;
one or more latches on the platform for locking the platform in place on the rails; and
the platform pivotable from horizontal position to a vertical storage position.

10. The air cargo container of claim 9 further comprising a first front post link for attaching the platform in a vertical position to the first front post.

11. The air cargo container of claim 9 with the platform 8-20 inches higher than the floor of the container, to allow cargo personnel to step up onto the platform to reach upper areas of the container.

12. An air cargo container, comprising:
a floor;
first and second side walls attached to the floor;
first and second tracks attached to the first and second side walls, respectively;
a platform above the floor, with the platform moveable horizontally along the tracks;
first and second rear rollers and first and second front rollers on the platform, with the tracks comprising channels, and with the rollers in the channels.

* * * * *